US008955328B2

(12) United States Patent
Böttcher et al.

(10) Patent No.: US 8,955,328 B2
(45) Date of Patent: Feb. 17, 2015

(54) BURNER ARRANGEMENT

(75) Inventors: Andreas Böttcher, Mettmann (DE); Timothy A. Fox, Hamilton (CA); Thomas Grieb, Krefeld (DE); Tobias Krieger, Duisburg (DE); Stephen A. Ramier, Fredericton (CA)

(73) Assignee: Siemens Aktiengesellschaft, Munich (DE)

( * ) Notice: Subject to any disclaimer, the term of this patent is extended or adjusted under 35 U.S.C. 154(b) by 1001 days.

(21) Appl. No.: 13/029,246

(22) Filed: Feb. 17, 2011

(65) Prior Publication Data

US 2011/0203285 A1 Aug. 25, 2011

(30) Foreign Application Priority Data

Feb. 19, 2010 (EP) ..... 10154116

(51) Int. Cl.

| | |
|---|---|
| ***F02C 1/00*** | (2006.01) |
| ***F02C 7/20*** | (2006.01) |
| ***F23R 3/28*** | (2006.01) |
| ***F23D 23/00*** | (2006.01) |

(52) U.S. Cl.

CPC ..... *F23R 3/283* (2013.01); *F23D 23/00* (2013.01); *F23C 2900/07021* (2013.01); *F23R 2900/00018* (2013.01)

USPC ..... 60/742; 60/796

(58) Field of Classification Search

CPC ..... F23R 3/60; F23R 3/283; F23R 3/286; F02C 7/20

USPC ..... 60/796, 798, 799, 737, 742, 740, 746, 60/752, 756

See application file for complete search history.

(56) References Cited

U.S. PATENT DOCUMENTS

| | | | | |
|---|---|---|---|---|
| 5,121,597 | A * | 6/1992 | Urushidani et al. | 60/778 |
| 5,415,000 | A * | 5/1995 | Mumford et al. | 60/747 |
| 6,082,111 | A | 7/2000 | Stokes | |
| 6,311,473 | B1 * | 11/2001 | Benjamin et al. | 60/776 |
| 6,327,860 | B1 * | 12/2001 | Critchley | 60/737 |
| 2004/0129797 | A1 | 7/2004 | Backander | |
| 2006/0026966 | A1 * | 2/2006 | Moraes | 60/796 |
| 2010/0071377 | A1 * | 3/2010 | Fox et al. | 60/740 |
| 2010/0199674 | A1 * | 8/2010 | Widener et al. | 60/737 |
| 2010/0223929 | A1 * | 9/2010 | Bailey et al. | 60/737 |

FOREIGN PATENT DOCUMENTS

| | | | |
|---|---|---|---|
| DE | 2946393 | A1 | 5/1980 |
| EP | 1843099 | A2 | 10/2007 |
| WO | WO 0022347 | A1 | 4/2000 |

* cited by examiner

*Primary Examiner* — Gerald L Sung

(57) ABSTRACT

A burner arrangement is provided. The burner arrangement includes a support and at least two fuel nozzles attached to the support in the direction of flow, with each fuel nozzle including a support-side section which includes a contact surface on the support side with which it rests on a supporting surface of the support, with at least two fuel nozzle tips embodied in one piece extending out from the support-side section in the direction of flow and the support-side contact surface including at least two extension parts projecting in the direction of the support, with the extension parts each embodying a channel through which fuel is fed in each case to the fuel nozzle tips through passages which are arranged in the support-side contact surface of the support-side section.

12 Claims, 3 Drawing Sheets

BURNER ARRANGEMENT

CROSS REFERENCE TO RELATED APPLICATIONS

This application claims priority of European Patent Office application No. 10154116 EP filed Feb. 19, 2010, which is incorporated by reference herein in its entirety.

FIELD OF INVENTION

The present invention relates to a burner arrangement and in particular to a burner arrangement for gas turbines.

BACKGROUND OF INVENTION

Essential component parts of a gas turbine include a compressor, a turbine with rotor blades and at least one combustion chamber. The rotor blades of the turbine are arranged as rotor blade rings on a shaft which in the main extends through the entire gas turbine, and is connected to a consumer load, for instance a generator for power generation. The shaft provided with the rotor blades is also called a (turbine) rotor. Between the rotor blade rings are guide vane rings, which act as nozzles to conduct the working medium through the turbine.

During operation of the gas turbine compressed air from the compressor is fed to the combustion chamber. The compressed air is mixed with a fuel, for example oil or gas, and the mixture is combusted in the combustion chamber. The hot combustion exhaust gases are eventually fed to the turbine as a working medium via a combustion chamber outlet, where they expand and cool and transfer pulse to the rotor blades, and thus perform work. The guide vanes are in this case used to optimize the transmission of pulse.

A typical burner arrangement for gas turbines, as described in U.S. Pat. No. 6,082,111 and as is used in particular in so-called pipe combustion chambers, generally has an annular support with a number of fuel nozzles distributed evenly around the circumference of the ring. Fuel nozzle openings are arranged in these fuel nozzles, with which fuel can be injected into an air inlet channel. The fuel nozzles represent a main stage of the burner, which serves to generate a premixed flame, in other words a flame in which the air and the fuel are mixed before ignition. To minimize the formation of $NO_x$ in the flame, premix burners are operated with lean air-fuel mixtures, in other words with mixtures which contain relatively little fuel.

Through the center of the annular fuel distribution ring typically extends a pilot burner, which is embodied as a diffusion burner, i.e. it generates a flame in which the fuel is injected directly into the flame, without first being mixed with air. Apart from starting up the gas turbine, the pilot burner also serves to stabilize the premixed flame, which to minimize the emission of pollutants is frequently operated in a range of the air-fuel ratio which without an auxiliary pilot flame could result in flame instabilities.

A burner arrangement such as the described burner arrangement typically has a number of fuel nozzles machined out of a metal block and welded to the support for feeding fuel to the combustion chamber. The support in this case distributes the fuel to the individual nozzles through built-in fuel passages.

To be able to provide enough space for machining the fuel passages, the support blank and thus the subsequent support must be of a certain minimum thickness. This increases the weight of the burner arrangement as well as the material costs. Machining in the fuel passages is also a labor-intensive process.

SUMMARY OF INVENTION

It is thus the object of the present invention to provide an advantageous burner arrangement, in particular an advantageous burner arrangement for gas turbines. It is a further object to provide an advantageous gas turbine with such a burner arrangement.

This object is achieved by a burner arrangement as claimed in the claims. The object in respect of the gas turbine is achieved by the specification of a gas turbine as claimed in the claims. The dependent claims contain advantageous embodiments of the invention.

An inventive burner arrangement includes a support and a number of fuel nozzles, which are mounted on the support in the direction of flow. It has been found that if the support is used as a fuel distributor it must have a minimum height, i.e. a certain thickness. Since the support embodied as a fuel distributor is exposed directly to the hot gas in the combustion chamber, it must consist of a high-temperature-resistant material, e.g. a super alloy. These are however very expensive.

According to the invention a burner arrangement hence has a support and at least two fuel nozzles attached to the support. Inventively the fuel nozzle thus also includes a support-side section, which on the support side has a contact surface, with which it rests on a contact surface of the support. In this case at least two fuel nozzle tips formed in one piece run from the support-side section in the direction of flow.

In this case the support-side contact surface has at least two extension parts projecting in the direction of the support, with the extension parts each embodying a channel through each of which fuel is fed to the fuel nozzle tips through passages connected downstream from the extension parts in the flow direction, which are arranged in the support-side contact surface of the support-side section. To this end the passages can also have an internal tube or a pipeline.

Thus a distribution channel in the support can be dispensed with. As a result the material strength of the support can be reduced, as a result of which weight and costs are saved. Additionally the demands on the installation space for the burner arrangement in the region of the side of the support facing away from the fuel nozzles are less stringent compared to the prior art. Overall the machining of the support is also simplified.

Remote from the support at least one distribution channel is provided, which supplies the extension parts remote from the support with fuel. Since the distribution channels are now located remote from the support and also—unlike the original distribution channels—are not directly in contact with hot gas, the distribution channels can now be made from lower-cost material. As a result a significant cost saving can be achieved. This means that the fuel is already distributed upstream (viewed in the in direction of flow) of the support and is not split between the channels downstream of the support.

In a particular embodiment the at least two extension parts are an oil channel and a gas channel respectively.

In addition there is also a further oil channel. This enables the at least two fuel nozzle tips to be provided with a separate oil channel in each case and thus also be controlled differently.

Preferably the extension parts, i.e. in particular the channels, are connected to form a positive or non-positive fit with the passages in the support-side contact surface of the support-side section of the fuel nozzle. In particular this is a screw connection or a welded connection.

In a preferred embodiment through-holes are provided in the support. The extension parts, i.e. the channels, are now routed through these through-holes in the support.

Preferably the extension parts, especially the channels have a distant end against the direction of flow with a first attachment element in each case. Furthermore the extension parts, i.e. the channels, are routed through the through-holes in the support. Subsequently the extension parts are attached to the support by means of a second attachment element interacting with the first attachment element.

In such cases the first attachment element on the second attachment element can be screw connections, especially the first attachment element can be an external thread and the second attachment element a nut.

Alternatively the first attachment element can be an extension part resting closely against the support. This is connected by a welded connection or another non-positive connection to the support on the support side. This means that the welded connection or the other non-positive connection represents the second attachment element so to speak. The welded connection or the other non-positive connection prevents the through-holes embodying undesired passages for the gas or compressed air of the turbine.

Preferably at least one seal exists between the first attachment element and the support. As an alternative or in addition there can be a seal present between the support-side contact surface of the support-side section and the support. In particular these seals are arranged around the passages in order to seal them to allow the passage of air.

Preferably the at least one seal is a c-ring seal or an O-seal.

In a preferred embodiment at least the fuel nozzle tips, the support side section and also the support side contact surfaces are embodied with the passages as a casting.

Preferably the extension parts with the passages are welded in the support-side section of the fuel nozzle. If the passages have an internal tube or are embodied as a pipeline, the extension parts are welded to the internal tube or the pipeline respectively.

As an alternative the extension parts can be embodied in one piece at least with the fuel nozzle tips, the support-side section and also the support side contact surface with the passages.

Preferably the support-side contact surface has at least one opening to attach the support side contact surface to the support. In this case this one opening can be a drilled hole. The support has openings or drilled holes corresponding to this. The support-side contact surface can be attached to the support by a screwed connection or a bolted connection. Bolts are frequently used for fast connections which often have to be released without axial stress instead of screws.

Preferably at least six holes are drilled for screw or bolt connections in the support side contact surface, with the drilled holes being distributed over the entire support side contact surface. As a result of the distribution pattern of the bored holes over the entire contact surface the fuel nozzle has high natural frequencies which can quickly be attenuated. Thus the fuel nozzle is stable in the face of natural frequencies.

The burner arrangement is especially provided in a gas turbine.

BRIEF DESCRIPTION OF THE DRAWINGS

Further features, attributes and advantages of the present invention emerge from the following description of exemplary embodiments with reference to the attached figures.

DETAILED DESCRIPTION OF INVENTION

Figure 1:
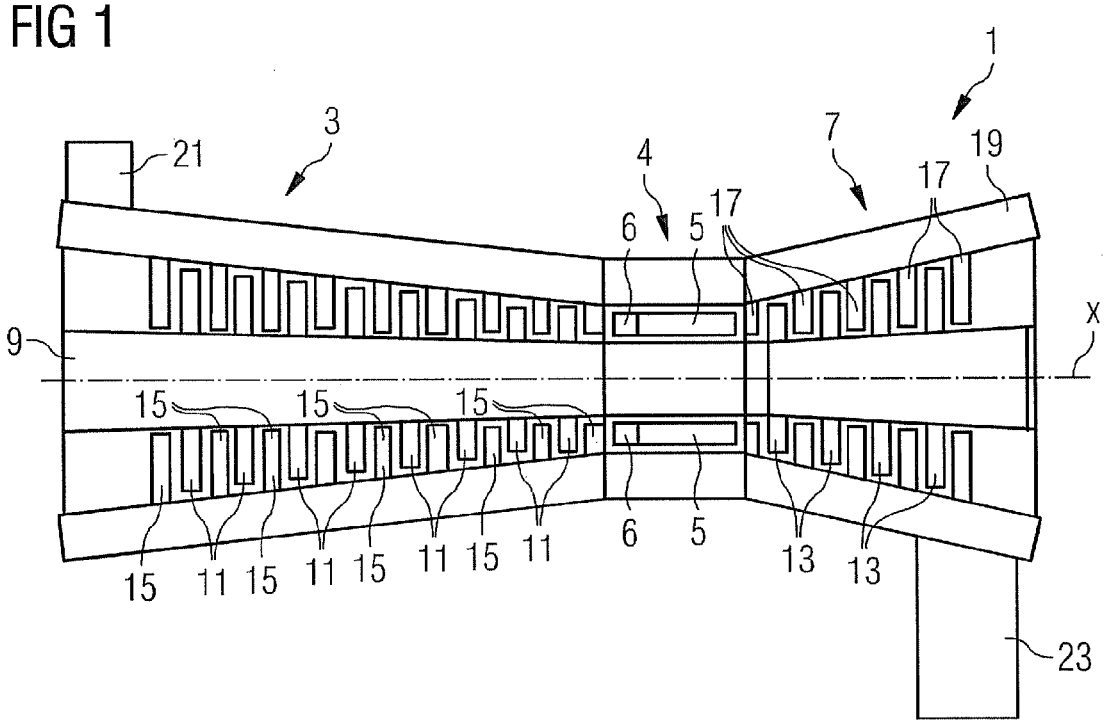
FIG. 1 shows a gas turbine in a highly diagrammatic illustration.

The structure and function of a gas turbine are explained below on the basis of FIG. 1, which shows a highly diagrammatic sectional view of a gas turbine. The gas turbine 1 includes a compressor section 3, a combustion section 4 which in the present exemplary embodiment includes a plurality of pipe combustion chambers 5 with burners 6 arranged thereon, but which can fundamentally also include an annular combustion chamber, and a turbine section 7. A rotor 9 extends through all sections and in the compressor section 3 supports compressor blade rings 11 and in the turbine section 7 turbine blade rings 13. Rings composed of compressor guide vanes 15 or rings composed of turbine guide vanes 17 are arranged between adjacent compressor blade rings 11 and between adjacent turbine blade rings 13, said rings extending out radially from a housing 19 of the gas turbine 1 in the direction of the rotor 9.

During operation of the gas turbine 1 air is sucked in through an air inlet 21 into the compressor section 3. There the air is compressed by the rotating compressor blades 11 and is fed to the burners 6 in the combustion section 4. In the burners 6 the air is mixed with a gaseous or liquid fuel and the mixture is combusted in the combustion chambers 5. The hot combustion exhaust gases, which are under high pressure, are then fed to the turbine section 7 as a working medium. On their way through the turbine section the combustion exhaust gases transfer a pulse to the turbine blades 13, whereby they expand and cool. Finally the expanded and cooled combustion exhaust gases leave the turbine section 7 through an exhaust 23. The transferred pulse results in a rotational movement of the rotor, which drives the compressor and a consumer load, for example a generator for generating electrical power or a production machine. The rings of turbine guide vanes 17 in this case serve as nozzles for conducting the working medium, in order to optimize the transmission of pulse to the turbine rotors 13.

Figure 2:
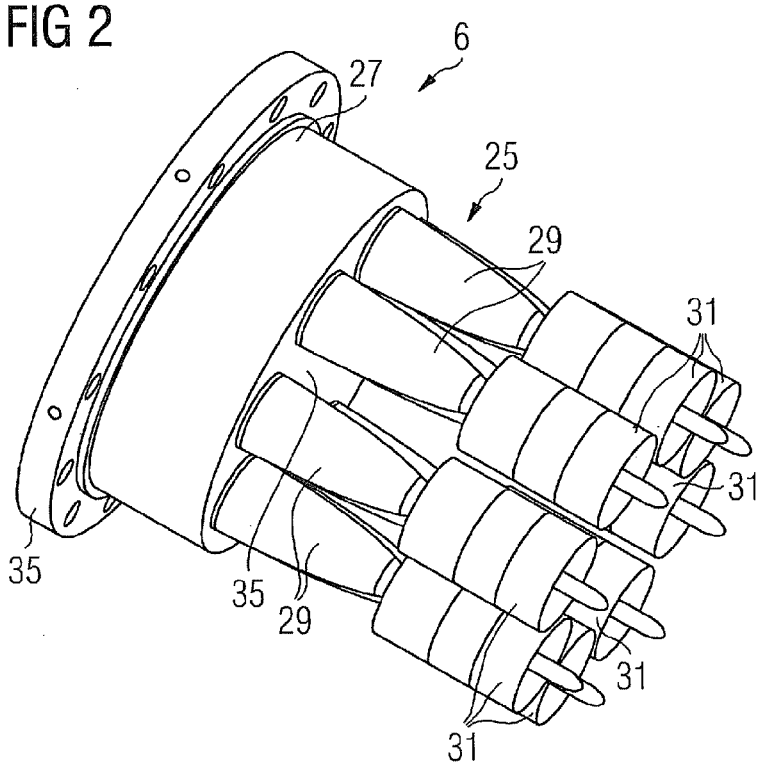
FIG. 2 shows a gas turbine burner arrangement according to the prior art in a perspective illustration.

FIG. 2 shows a burner 6 of the combustion section 4 in a perspective illustration. The main components of the burner 6 are a fuel distribution ring 27, eight fuel nozzles 29 which extend out from the fuel distribution ring 27, and eight swirl generators 31 arranged in the region of the tips of the fuel nozzles 29. The fuel distribution ring 27 and the fuel nozzles 29 together form a burner housing, through which fuel lines extend to injection openings which are arranged within the swirl generator 31. The fuel nozzles 29 can be welded to the fuel distribution ring 27. The burner can be connected to fuel feed lines via a number of pipe sockets (not shown). The burner 6 can be attached to a pipe combustion chamber by means of a flange 35 such that the fuel nozzles 29 point to the interior of the combustion chamber.

Although the burner 6 shown in FIG. 2 has eight fuel nozzles 29, it is also possible to equip it with a different number of fuel nozzles 29. The number of fuel nozzles 29 can in this case be larger or smaller than eight, for example six fuel nozzles 29 or twelve fuel nozzles 29 can be present, which each have their own swirl generator. Furthermore a pilot fuel nozzle is generally arranged in the center of the burner. The pilot fuel nozzle is not shown in FIG. 2 for the sake of clarity.

In the combustion process, air is fed from the compressor through the swirl generator 31, where it is mixed with fuel. The air-fuel mixture is then combusted in the combustion zone of the combustion chamber 5 in order to form the working medium.

The role of the support 27 is to distribute the fuel to the fuel nozzles 29. To this end it has fuel channels inside it, each of which supplies a number of nozzles 29 with fuel. Connectors 2 are present on the support 27 for fuel feed lines, which conduct the fuel to the support 27, in which it is then distributed to the fuel nozzles 29. Different types of fuel can also be used in this case. To this end the fuel nozzles 29 have at least one fuel opening at which the fuel can escape.

The channels are typically milled by machine into a cylindrical support blank and then covered with welded-on elements. Likewise the lead-throughs for the pipelines are machined into the support blank In order to provide enough space for machining the lead-throughs and the gas passages, the support blank and thus the subsequent support must have a certain minimum thickness. This increases the weight of the burner arrangement as well as the material costs. Machining is also labor-intensive and consequently is associated with high costs. Another problem is manufacturing the fuel nozzles 29 onto the support 27, since the burner nozzles 29 must be welded perpendicular to the support 27. This manufacturing is moreover very protracted and is associated with increased complexity and thus costs. The fuel nozzles are also welded to the swirl generator 31. The support 27 is exposed to high temperatures, as are the fuel nozzles 29. Hence supports 27 and also fuel nozzles 29 must be manufactured from a high-temperature-resistant material, e.g. corrosion-resistant nickel base alloys. However, this material likewise drives costs up steeply.

Figure 3:
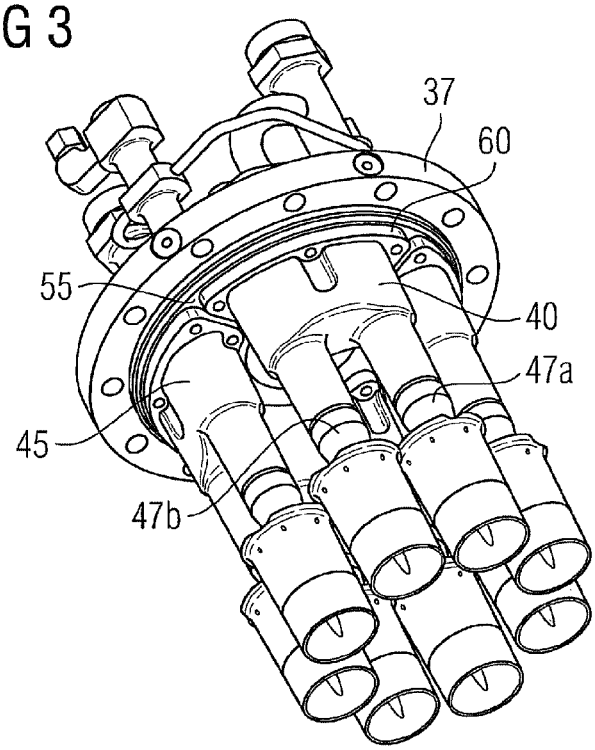
FIG. 3 shows an inventive burner arrangement with fuel nozzle tips and support.

This is now avoided with the aid of the invention. According to the invention a burner arrangement with a support 37 and at least two fuel nozzles 40 attached to the support 37 in the direction of flow is provided. (FIG. 3). In this case each fuel nozzle 40 has a support-side section 45 which on the support side has a contact surface 60 with which it rests on a supporting surface 55 of the support 37. At least two fuel nozzle tips 47*a*, 47*b* formed in one piece run from the support-side section 45 in the direction of flow, in other words in the direction of the combustion chamber 5. The support-side contact surface 60 has at least two extension parts projecting in the direction of the support 37 which are especially embodied as channels, especially as one oil channel 50*a* and one gas channel 51. The extension parts can also be manufactured as a pipeline. Fuel is fed by the channels 50*a*, 51 through passages 65 described in greater detail below in the support-side contact surface 60 of the support-side section 45 of the fuel nozzle. For this purpose a tube not shown in the diagram can also be fitted into these passages 65. In this exemplary embodiment two oil channels 50*a* and 50*b* are provided in particular. This embodiment is especially advantageous since the two fuel nozzle tips 47*a*, 47*b* embodied in one piece which extend out from the support-side section 45 in the direction of combustion chamber 5 can now be supplied with fuel by the two oil channels 50*a* and 50*b*.

Provided in support 37 are feed-through holes (not shown separately) through which the oil channels 50*a*, 50*b* and the gas channel 51 are routed through the support 37.

Figure 4:
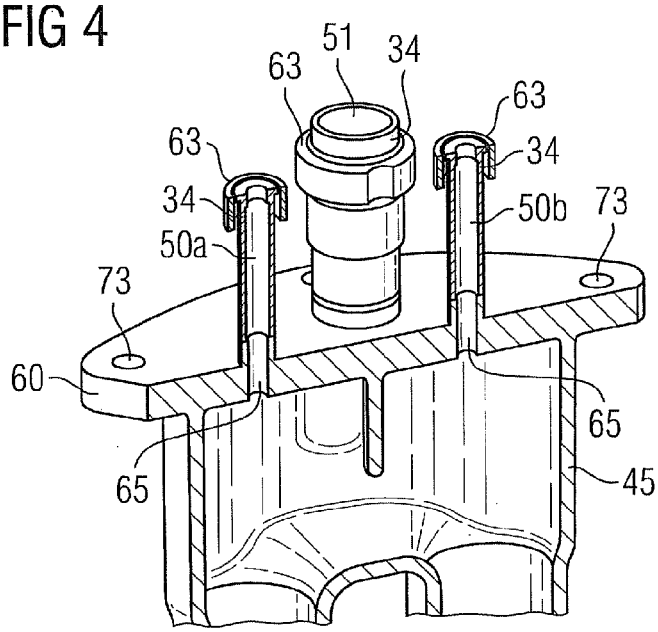
FIG. 4 shows an inventive burner arrangement in cross section.

Passages 65 (FIG. 4) for the fuel are made in the support-side contact surface 60 of the support-side section 45. These passages 65 can be inserted afterwards by drilling holes for example or can be manufactured during production. Channels 50*a*, 50*b* and 51 are now connected to these passages 65 by way of a positive or non-positive fit. If the passages 65 have internal tubes or are embodied as pipelines, the channels 50*a*, 50*b* and 51 are connected to the latter. Fuel is transported through the channels 50*a*, 50*b* and 51 and then flows through the respective passages 65 into the fuel nozzle 40 to the fuel nozzle tips 47*a*, 47*b*.

In such cases making a positive or non-positive fit can mean that the channels 50*a*, 50*b* and 51 are welded to the passages 65 or are attached during production, e.g. by casting.

On the remote side of the support is at least one distribution channel (not shown), but mostly two distribution channels for oil and gas respectively, which supplies the channels 50*a*, 50*b* and 51 with the respective fuel on the remote side of the support. Since the distribution rings do not come into contact directly with the hot gas in the combustion chamber, these can be manufactured from a low-cost material.

Additionally the demands on the installation space for the burner arrangement in the region of the side of the support facing away from the fuel nozzles are less stringent compared to the prior art. Overall the machining of the support is also simplified.

Channels 50*a*, 50*b* and 51 are routed through the through-holes in the support 37. In addition the channels 50*a*, 50*b* and 51 have a distant end 34 against the direction of flow, with a first attachment element in each case and are attached to the support 37 by a second attachment element interoperating with the first attachment element.

In such cases the first attachment element and second attachment element can involve a screw connection.

In the exemplary embodiment presented here the attachment is formed by an extension part 63 resting closely against the support which is connected dimensionally stably to the support 37, especially welded to it. In addition there can be at least one seal between the first attachment element, for example the extension part 63 and the support 37. However the welding itself can also be embodied as a seal here.

There can also be a seal between the support-side contact surface 60 of the support-side section 45 and the support 37, especially all around the passages 65. Here too the seal can be a weld.

Figure 5:
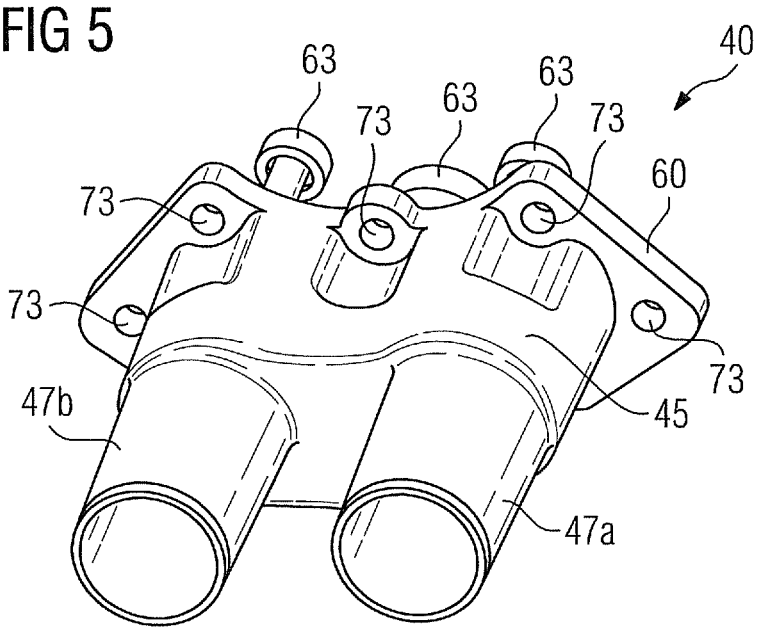
FIG. 5 shows an inventive burner arrangement from the front.

The support-side contact surface 60 has six holes 73 bored in it (FIG. 5). To this end the support 37 has corresponding openings or bored holes. As a result of these bored holes 73 the fuel nozzle 40 can be attached to the support 37 by means of a screw connection or a bolt connection. In this case the bored holes 73 are distributed over the entire support-side contact surface 60. As a result of this distribution of the bored holes 73 the fuel nozzle 40 has high natural frequencies which can be quickly attenuated. Thus the fuel nozzle 40 is stable in the face of natural frequencies. The screwed or bolted connections practically attach the fuel nozzle 40 additionally to the welded-on extension parts 63 on the support 37 and thus accept a large part of the pressure stresses during operation. In fuel nozzles of the prior art fees were born to a large extent by the fuel nozzle tips 47*a*, 47*b* and the channels in the fuel nozzle tips, which has greatly shortened the service life of the burner arrangement. The welding of the extension parts 63 on the support 37 can additionally attach the fuel nozzle 40 to the support 37.

The bored holes 73 in the support-side contact surface 60 and also the holes corresponding to them in the support 37 are provided with large measurement tolerances so that fast and simple manufacturing is possible.

Because of the inventive burner arrangement it is possible to reduce the costs significantly. This is attributable to the fact that the fuel distributor 37 is now significantly less thick than the fuel distributor 27 embodied in the prior art. All bored holes or openings can be manufactured quickly and easily, since no particularly precise measuring tolerances are called for or need to be complied with. The service life can be significantly increased. Since only the welded connections have to be checked, this can be undertaken more often. Welded connections can also be refreshed or improved to comply with standards without any evidence of failure, which likewise has the effect of extending the service life of the component.

The invention claimed is:

1. A burner arrangement, comprising:

a support; and at least two fuel nozzles attached to the support in a flow direction, wherein each fuel nozzle includes a support-side section which has a contact surface on a support side, wherein the contact surface rests against a supporting surface of the support, wherein each fuel nozzle comprises at least two fuel nozzle tips, the least two fuel nozzle tips extending outwards in the flow direction from the support-side section of the fuel nozzle, wherein the contact surface of the support-side section includes at least two extension parts projecting in a direction of the support, and wherein the at least two extension parts each embody a channel through which fuel is supplied to the at least two fuel nozzle tips through a plurality of passages connected downstream from the at least two extension parts in the flow direction, which are arranged in the support-side contact surface of the support-side section.

2. The burner arrangement as claimed in claim 1, wherein the at least two extension parts are an oil channel and a gas channel respectively.

3. The burner arrangement as claimed in claim 2, wherein a further oil channel is present.

4. The burner arrangement as claimed in claim 3, wherein each of the respective oil channels supplies one fuel nozzle tip of the at least two fuel nozzle tips with oil.

5. The burner arrangement as claimed in claim 1, wherein the at least two extension parts are connected to make a positive or non-positive fit with the plurality of passages in the support-side of the support-side section of the at least two fuel nozzles.

6. The burner arrangement as claimed in claim 1, wherein the at lest two extension parts each comprise a remote end against the direction of flow, each remote end comprising a first attachment element, and wherein the at least two extension parts are attached to the support using the first attachment elements.

7. The burner arrangement as claimed in claim 1, wherein at least the at least two fuel nozzle tips of the support-side section and the support side contact surface with the plurality of passages are embodied as a casting.

8. The burner arrangement as claimed in claim 1, wherein the at least two extension parts with the plurality of passages are welded in the support-side section of the at least two fuel nozzles.

9. The burner arrangement as claimed in claim 1, wherein the as least two extension parts are embodied in one piece.

10. The burner arrangement as claimed in claim 1, wherein the support-side contact surface includes an opening for attaching the support-side contact surface to the supporting surface of the support.

11. The burner arrangement as claimed in claim 10, wherein at least six openings are provided in the support side contact surface, openings being distributed over an entire support-side contact surface.

12. A gas turbine, comprising:

a burner arrangement, comprising:

a support; and at least two fuel nozzles attached to the support in a flow direction, wherein each fuel nozzle includes a support-side section which has a contact surface on a support side, wherein the contact surface rests against a supporting surface of the support, wherein each fuel nozzle comprises at least two fuel nozzle tips, the least two fuel nozzle tips extending outwards in the flow direction from the support-side section of the fuel nozzle, wherein the contact surface of the support -side section includes at least two extension parts projecting in a direction of the support, and wherein the at least two extension parts each embody a channel through which fuel is supplied to the at least two fuel nozzle tips through a plurality of passages connected downstream from the at least two extension parts in the flow direction, which are arranged in the support-side contact surface of the support-side section.

* * * * *